US008770081B2

(12) United States Patent
David et al.

(10) Patent No.: US 8,770,081 B2
(45) Date of Patent: Jul. 8, 2014

(54) CLOSED TUBULAR FIBROUS ARCHITECTURE AND MANUFACTURING METHOD

(75) Inventors: Patrick David, Saint Cyr sur Loire (FR); Bruno Bompard, Lyons (FR); Jean Luc Bonnand, St. Joseph (FR)

(73) Assignee: Commissariat à l'énergie atomique et aux énergies alternatives, Paris (FR)

( * ) Notice: Subject to any disclaimer, the term of this patent is extended or adjusted under 35 U.S.C. 154(b) by 195 days.

(21) Appl. No.: 13/510,557

(22) PCT Filed: Nov. 18, 2010

(86) PCT No.: PCT/EP2010/067736

§ 371 (c)(1),
(2), (4) Date: Jul. 18, 2012

(87) PCT Pub. No.: WO2011/061249

PCT Pub. Date: May 26, 2011

(65) Prior Publication Data

US 2012/0273085 A1 Nov. 1, 2012

(30) Foreign Application Priority Data

Nov. 18, 2009 (FR) ..... 09 58155

(51) Int. Cl.
*D04C 1/06* (2006.01)

(52) U.S. Cl.
CPC ..... *D04C 1/06* (2013.01)
USPC ..... 87/13

(58) Field of Classification Search
CPC ..... D04C 1/06
USPC ..... 87/5, 7, 9, 11, 13; 139/384 R, 387 R
See application file for complete search history.

(56) References Cited

U.S. PATENT DOCUMENTS

| | | | |
|---|---|---|---|
| 3,586,058 | A | 6/1971 | Ahrens |
| 3,765,557 | A | 10/1973 | Giwer |

(Continued)

FOREIGN PATENT DOCUMENTS

| | | |
|---|---|---|
| DE | 546 967 | 3/1932 |
| EP | 0 487 374 | 5/1992 |
| WO | WO 89/05724 | 6/1989 |

OTHER PUBLICATIONS

"Composites Engineering Handbook." P. K. Mallick, CRC Press, 1997, ISBN 0824793048, 9780824793043, Marcel Dekker Inc ; New-York, Basel, Hong Kong, pp. 82-85, 89-92.

(Continued)

*Primary Examiner* — Shaun R Hurley
(74) *Attorney, Agent, or Firm* — Knobbe Martens Olson & Bear LLP

(57) ABSTRACT

A tubular fibrous architecture is disclosed. According to one aspect, the tubular fibrous architecture includes a closed tubular part in at least one of its ends or bottom. The closed tubular part includes an architecture in which a textile material, such as a thread, roving, ribbon or bundle of threads, is continuously output from the bottom. Each textile material that is output from the bottom is continuously wound about the tubular part. All of the textile materials at the junction between the bottom and the remainder of the tubular part are continuous and there is a continuous geometric transition between the bottom architecture and the architecture of the remainder of the tubular part such that the textile materials in the tubular part cross over. A method of making such a tubular fibrous architecture is also disclosed.

25 Claims, 5 Drawing Sheets

(56) References Cited

U.S. PATENT DOCUMENTS

| | | | | |
|---|---|---|---|---|
| 5,070,914 | A | 12/1991 | Fukuta et al. | |
| 6,655,253 | B2 * | 12/2003 | Uchida et al. | 87/6 |
| 7,204,903 | B2 * | 4/2007 | Yasui | 156/149 |
| 7,566,376 | B2 * | 7/2009 | Matsuoka | 156/149 |
| 8,048,147 | B2 * | 11/2011 | Adams | 623/1.35 |
| 8,151,682 | B2 * | 4/2012 | Lilburn et al. | 87/9 |
| 2005/0076995 | A1 * | 4/2005 | Yasui | 156/148 |
| 2005/0077643 | A1 * | 4/2005 | Matsuoka | 264/103 |
| 2005/0098027 | A1 * | 5/2005 | Karazissis Dolzanelli | 87/2 |
| 2007/0119295 | A1 | 5/2007 | McCullagh et al. | |
| 2008/0264551 | A1 | 10/2008 | Wood | |
| 2011/0283871 | A1 * | 11/2011 | Adams | 87/9 |

OTHER PUBLICATIONS

International Search Report and Written Opinion for related International Application No. PCT/EP2010/067736 dated Apr. 8, 2011 by European Patent Office.

"Handbook of Composite Reinforcements." 1993. Y. Ed. Lee, Stuart M. Lee, Stuart M. Lee. pp. 25-27.

"Handbook of Composites." George Lubin, Stanley T. Peters, Springer, 1998, ISBN 0412540207, 9780412540202, 1118 pages, pp. 413-418, 420-424.

M. Munro et al., "A Comparison of Helical Filament Winding and 2D Braiding of Fiber Reinforced Polymeric Components", Material and Manufacturing Processes, vol. 10, No. 1, 1995, pp. 37-46.

N 2511 in Techniques de I'lngenieur (Apr. 10, 2006).

* cited by examiner

FIG.6
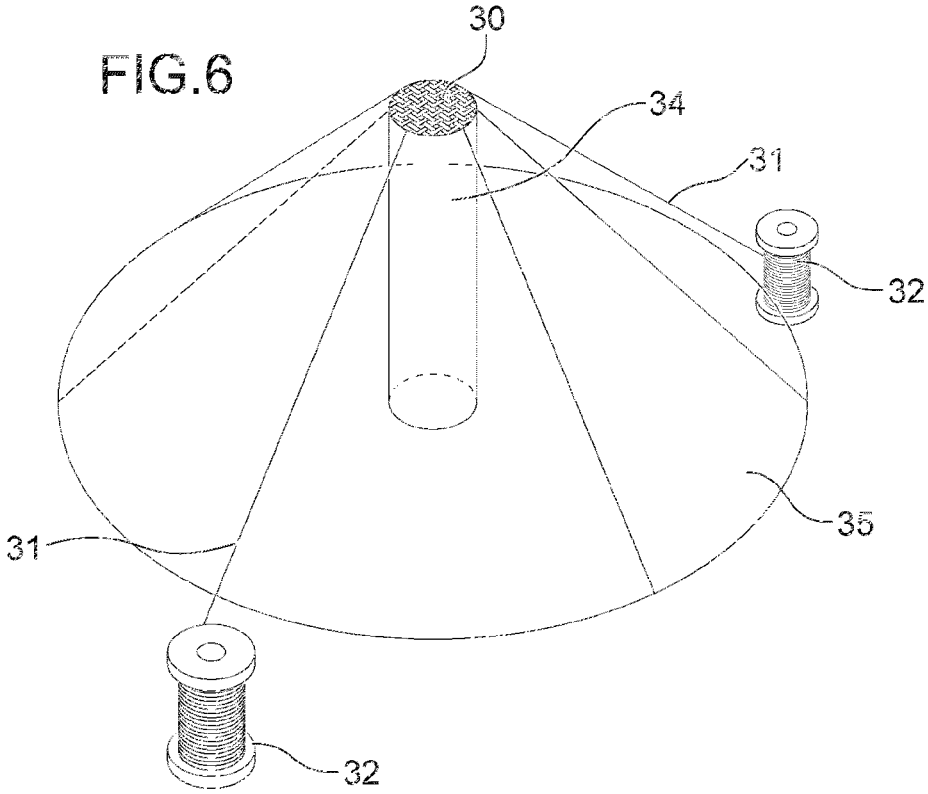
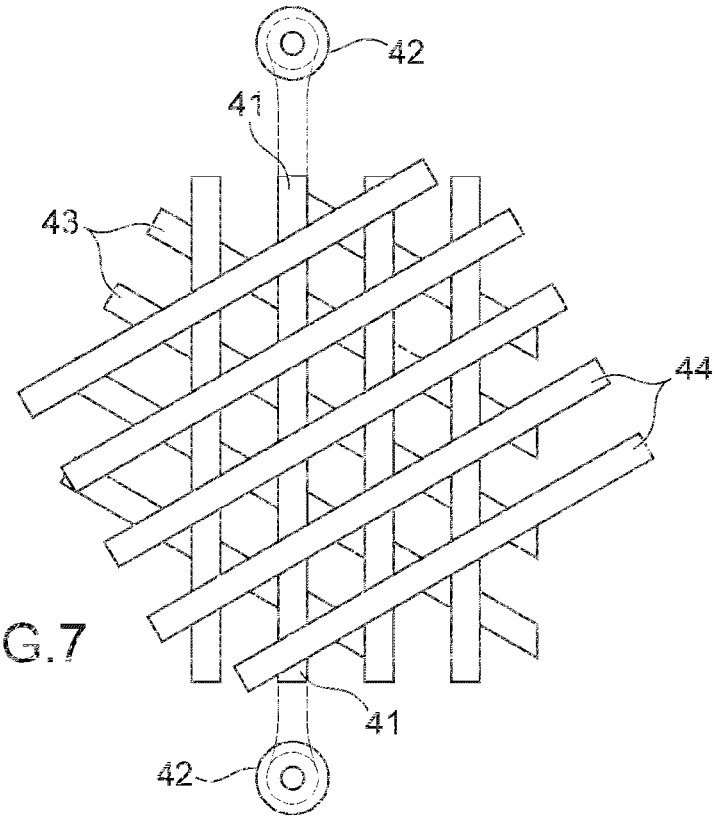
FIG.7

CLOSED TUBULAR FIBROUS ARCHITECTURE AND MANUFACTURING METHOD

RELATED APPLICATIONS

This application is a U.S. National Phase of International Application No.: PCT/EP2010/067736, filed Nov. 18, 2010, which claims the benefit of French Patent Application No. 09 58155 filed Nov. 18, 2009, each of which is incorporated by reference in their entirety.

FIELD OF THE INVENTION

Fibrous textiles and structures are obtained by different fibre forming techniques. The main techniques are knitting, weaving, braiding, placement of fibres, batting and filament winding. The technique, production parameters and the type of fibres used depend on the required characteristics (geometric, mechanical, electric, surface appearance, formability or impregnability, injectability) for the partly finished product or the finished product to be manufactured. The nature of the fibres to be used is very varied: natural fibres, organic fibres, mineral or ceramic fibres (glass, carbon, silicon carbide, basalt, etc.). Fibrous structures are usually used as reinforcement for composite materials (shells, panels and structures, reservoirs, etc.) but they also have some direct applications (filter or heating fabrics, braided cables, insulating knits, etc.).

There are several techniques for making fibrous structures. Braiding has the advantages that geometric design of structure thread paths (generic term) is very flexible, the structures obtained have good dimensional stability and good mechanical properties (stiffness, behaviour in torsion, resistance to damage), and complex shapes can be made directly (braiding on mandrel) with a high fibre content. However, this technique is not used quite as frequently as weaving or knitting because it is relatively slow and the mechanical properties of composites in compression are not as good. There are many similarities between braiding and filament winding. Maximum fibre contents are lower but it can be used to obtain more complex parts and give better shock resistance. The two techniques can sometimes be used in a complementary manner to make objects.

BACKGROUND

Textile braids are fibrous architectures obtained by interlacing of threads (threads, roving, ribbons or bundles of threads). Thread arrangements relative to each other are defined by the shape and characteristics of the object to be obtained. The simplest braid that can be made, also called a mat, is composed of only three threads, in which one of the two external threads is alternately placed in the centre by crossing over, so that each thread periodically passes into the centre from one side and then from the other side of the braid. Braids composed of a larger number of threads are made using the same interlacing principle but more generally, with threads that follow the same direction over a longer distance.

"2-D" braids are composed of biaxial and triaxial braids. Biaxial braids are composed of two groups of threads that cross over each other at an angle of $\pm\theta$, where $\theta$ is defined as the braiding angle. FIG. 1 diagrammatically shows a biaxial braid composed of a first group of threads 1 and a second group of threads 2 that cross each other. The braiding angle $\theta$ can vary between about 5° and 85° between a braiding axis x and an axis of inclination y, these values being practical manufacturing limits.

The triaxial braids are composed of the presence of an additional group of threads in line along the braiding direction ($\theta$=0°). FIG. 2 shows a view of a triaxial braid composed of a first group of threads 3, a second group of threads 4 and a third group of threads 5 aligned along the braiding direction. Interlacing patterns are defined by two numbers: the number of threads above which a thread in the opposite group passes followed by the number of threads below which it passes. The main patterns used are (1, 1) (diamond braiding), (2, 2) (normal braiding), (3, 3) (Hercules braiding). The braiding thickness is constant and is equal to the thickness of 2 threads (biaxial). If a part is to be completely covered when covering a form (that may or may not be eliminated later), the ratio of the diameters must remain between 1 and 3, corresponding to an angle that can vary between 20° and 70°. Nevertheless, note that the mechanical strength is not the same in zones with different diameters and it also varies by a factor of 1 to 3. The tubular braids are obtained by doing the braiding either directly on a liner (or envelope) from which the part to be obtained is made or on a mandrel. Thick structures are made by stacking several layers of braids together (patterns may be different) on each other.

"3-D" braids are an extension of "2D" braids obtained with simultaneous braiding of several layers of "2D" braids with a periodic connection from layer to layer. This type of texture is also known as "interlock braid". This can give greater thicknesses, connections between layers (leading to better mechanical properties such as a better resistance to delamination) and more complex and more precise forms.

Braiding is a very old traditional textile technique (1748, weaving loom made by Thomas Wadford), originally used to make ropes, laces and reinforcement for tubes.

FIG. 3 shows the principle diagram of a circular braiding machine like that described in the "Handbook of Composite Reinforcements" by Y. Ed. Lee et al.

A 2D braiding machine that can be either vertical or horizontal is composed of a set of spindles 11 (thread bobbin supports) that move inside a guide path defined on a table and according to a braiding plane 12. For a simple circular braiding machine for making tubes, the spindles follow undulating paths around the periphery of the circular table, half in one direction around the circle and the other half in the other direction, the two paths being interlaced as shown in FIG. 4. A straight displacement system 14 perpendicular to the braiding table is synchronised relative to the movement of the spindles to hold the braid 13, possibly on a mandrel 15. Information on this subject can be found in article N 2511 in Techniques de l'Ingénieur (Apr. 10, 2006) and the "Handbook of Composite Reinforcements" mentioned above. Reference 16 represents the convergence zone of threads to be braided 17. Reference 18 represents an axial thread, and reference 19 represents an axial thread-guide.

The ratio of the spindle displacement speed to the mandrel displacement speed defines the braiding angle. The ratio of the number of bobbins relative to the number of intersections defines the type of the braiding pattern made. The addition of fixed bobbins can give triaxial braids. If the spindles turn back after some distance instead of making complete turns, then flat braids are obtained. Spindles comprise uniform tension systems, for tensioning or for compensating of threads (the distance from a spindle to the convergence zone on the braid not being constant) to obtain braids with uniform patterns and required compactness. As mentioned above, the thickness of a layer (biaxial braid) is equal to twice the thickness of a thread. Conventionally, a thick tubular part can be obtained by stopping displacement of the mandrel when the required length has been braided, the threads can be cut and a second pass can be made, and then the operation can be repeated until the required thickness is obtained.

There are two types of 3D braiding machines. The first is said to be rectangular, with an alternating movement along two directions in order to obtain "Cartesian" braids. The second type is circular with an alternating movement in the radial and circular directions, resulting in "polar" braids. Sections with different shaped cross-sections can be obtained by predetermined positioning of the spindles on the machine in the initial state. Hollow sections are obtained by polar braiding, solid sections are obtained by Cartesian braiding. Further information on this subject can be found in article N 2511 in Techniques de l'Ingénieur, mentioned above and in "Handbook of Composites" by G. Lubin et al., Springer, 1998.

Structural composite materials are composed of fibrous reinforcement such as braids and a matrix that is the material between the fibres (and gives cohesion to the material). They are characterised by different types of matrices:

organic matrices: thermoplastic or thermosetting, metallic matrices, mineral or ceramic matrices (glass, carbon, silicon carbide, etc.).

There are no braided tubular structures closed at one or both ends. Due to the inherent principle of 2D and 3D braiding (see FIG. 3), the braids cannot be closed because the start and the end of the operation begin and end with parallel threads (in bundle), either held together at the formation point (start of braiding) or ending up at the bobbins (end of braiding). Braiding begins and ends on diameters between two values dependent on the braiding angles. No technical literature and no patents describe any way of making structures for which the main body is a braid and that are capable of continuously obtaining forms with a smaller diameter than the minimum diameter or for closing it, for all threads. Further information about this subject can be found in the article "A Comparison of Helical Filament Winding and 2D Braiding of Fiber Reinforced Polymeric Components" by M. Munro et al., Material and Manufacturing Processes, vol. 10, No. 1, pages 37 to 46, 1995. Existing solutions to close braid-based structures, particularly necessary for pressure vessel applications, include metallic inserts at the ends.

U.S. Pat. No. 7,204,903 very briefly discloses an innovative solution. Braiding is done on a liner that is cylindrical shaped at the centre and hemispherical (domes) at the ends. At least one of the domes has an insert at its end (pole). Braiding is conventionally done on the cylindrical part and on the hemispherical part as far as the insert. The innovation lies in the fact that at this moment, a second layer is made by stopping braiding and turning the bobbins (by about 180°), instead of starting in the opposite direction; half of the bobbins turn in one direction and the other half turn in the other direction which puts the bobbins opposite their initial position. Braiding is then resumed (next layer) along the inverse direction to the previous direction. The advantage mentioned compared with conventional braiding is that there is no need to cut the threads or to bend them and fold them over if they are sufficiently flexible, when changing from one braiding layer to the next. The result of the fabrication method used is that during the 180° rotation, one layer out of two in the hemispherical part corresponds to thread placements without any connection between each other (equivalent to filament winding) and a large thickness at the insert (the threads overlap each other in contact with the insert). Note that no value or information is given about braiding itself or the diameters of the cylinder or the insert, neither in the description of the invention nor the examples (the only numerical value is the rotation angle between two braids). The information in this patent does not solve the problem of closing one end, simply the integration of an insert. Furthermore, the invention does not offer a solution for the small diameters problem.

Document US 2008/0264551 discloses the fabrication of composite vessels (cylinder and hemispherical bottoms) based on dry threads (not impregnated with resin) for the storage of low or high pressure gas. The invention lies in the fact that the internal liner acts as a mould during injection of the resin and also as a heating or cooling system during polymerisation. Braiding is done by a combination of biaxial or triaxial braiding on the faces of the domes, by turning over and deforming the biaxial braid and sealing the ends of the threads by a means such as gluing. According to the authors, this method gives good control over the thickness and the contour. This system uses conventional braids and it does not result in continuity of the threads on the domes because their ends are glued, nor closing based on threads.

Document WO-A-89/05724 discloses the fabrication of a bottle made of a composite material at a moderate price for the storage of high pressure gas. The ends of the bottles comprise two end pieces connected to each other through a central rod, one of the two being used for adding or drawing off of gas. The body of the bottle is composed of coaxial braids with a resin matrix. The ends may be truncated or hemispherical, made of metal or plastic. This document does not describe the braiding technique, apparently the braids used are standard. Nor does this patent describe how to make closed braids because the ends are composed of inserts at the ends.

Document EP-A-0 487 374 presents a high pressure gas storage vessel composed of threads placed by filament winding and/or a braid. The vessel is cylindrical in shape with bottoms. It gives no information about the braid used other than that it is used as a longitudinal reinforcement and therefore a priori on the cylindrical part. There is no description of a closure by a continuous thread.

U.S. Pat. No. 3,765,557 presents a means of making a high pressure vessel made by filament winding in which the standard thread is replaced by a braided thread. Therefore, this patent does not apply to the braiding technique and gives very different structures. It is also conventional to be able to obtain a closed end, but with an overthickness by filament winding.

U.S. Pat. No. 5,070,914 discloses a new woven architecture and its fabrication means. The technique is based on weaving, with threads starting radially and circumferentially woven threads following a spiral. These structures are based on a path of threads following the line of a spiral without any cylindrical or axial symmetry, unlike the invention which will be described in appended claims.

SUMMARY OF CERTAIN INVENTIVE ASPECTS

The forms that can be obtained with braiding are solid forms (cables, strands), flat braids and tubular forms with varied sections and variable on the same part for example air conduits for aircraft). There is a technical limitation for tubular braids that makes it impossible to close braids at their ends, or to make a large reduction in their section. The purpose of this invention is to overcome this limitation, enabling continuity of the fibrous architecture, keeping the same reinforcement threads between the closed part or the bottom and the body or the tubular portion of the part. The purpose of the invention is firstly a new type of tubular fibrous architecture (or hollow form) closed at least one end, and its manufacturing process or method.

Therefore, the purpose of the invention is a method for making a tubular fibrous architecture closed at one of its ends, the method comprising the following steps:

a) make a pair of bobbins from threads, toying, ribbons or bundles of threads, hereinafter referred to under the generic term of threads, each pair of bobbins being made by winding a first part of a thread from a first end of the thread, onto a first bobbin in the pair and winding a second part of the thread from the second end of the thread, onto the second bobbin of the pair, b) place pairs of bobbins on the spindles of a loom, arranging them as a function of a required Primary Structure, c) make the Primary Structure on the loom in step b), this Primary Structure corresponding to the bottom of the fibrous architecture, d) put a support conforming with the tubular part of the fibrous architecture into position on a loom to support, position and maintain said threads during their crossover in the next step, e) use said threads and the loom in step d) to make the tubular part of the fibrous architecture on the support, f) repeat the previous steps as many times as necessary, if any.

According to one embodiment, the pairs of bobbins are arranged in step a) such that the Primary Structure obtained is radiating.

According to another embodiment, the pairs of bobbins are arranged in step a) such that the Primary Structure obtained is of the biaxial type.

According to another embodiment, the pairs of bobbins are arranged in step a) on the spindles and in the creel of the loom, such that the Primary Structure obtained is triaxial.

The threads on the bobbins in step d) may be supported, positioned and held in place so as to obtain a biaxial tubular architecture. They may also be supported, positioned and held in place so as to obtain a triaxial tubular architecture.

The loom in step d) could be the loom in step b).

The Primary Structure may be made using a technique chosen from among weaving, braiding, batting and placement of threads. It may be a multi-layer, multi-dimensional or multi-directional texture, in which the threads derived from it are used to make the tubular part that is then multi-layer.

The tubular part of the fibrous architecture may be made on the support using a technique chosen from among weaving, braiding, batting and placement of threads. It may also be made on the support using multi-layer, multi-dimensional or multi-directional texture methods.

The loom in step d) may be a weaving loom, a braiding machine, a batting machine or a thread placement machine.

The process may include an additional step g) during which the tubular part of the fibrous architecture is prolonged on one end of the support to form a second bottom of the fibrous architecture. The additional step g) may be continued until a second closed bottom is obtained by braiding, weaving, batting or placement of threads.

In step c), the Primary Structure may possibly be made by incorporating at least one insert or at least one end piece into the Primary Structure.

During step e), the tubular part of the fibrous architecture may be made by incorporating at least one insert or at least one end piece into the tubular part.

Another purpose of the invention is a tubular fibrous architecture with a closed tubular part at least one of its ends or bottom, in which:

the tubular part is composed of an architecture in which each thread, roving, ribbon or bundle of threads, hereinafter referred to under the generic term thread, is continuously output from the bottom, each thread output from the bottom is continuously located in the tubular part, through each of its ends, all threads at the junction between the bottom and the remainder of the tubular part are continuous and there is a continuous geometric transition between the bottom architecture and the architecture of the remainder of the tubular part, the threads in the tubular part cross over, preferably in accordance with a braiding or weaving method.

The bottom may be composed of a structure obtained by superposition of batting, a two-directional fabric, three-directional fabric, multi-layer or multi-directional fabric.

The tubular part may be formed by superposition of batting, three-dimensional fabric, multi-layer or multi-directional fabric.

At least one insert or end piece may be incorporated into at least one bottom.

At least one insert or end piece may be incorporated into at least the tubular part.

The threads may be composed of organic, metallic, mineral or ceramic fibres.

Another purpose of the invention is a composite material composed of the fibrous architecture described above, embedded in an organic, metallic or mineral matrix.

While the present invention is described herein in connection with certain embodiments, it is to be understood that the invention is not limited to the disclosed embodiments, but, on the contrary, is intended to cover various modifications and equivalent arrangements included within the spirit and scope of the appended claims, and equivalents thereof.

BRIEF DESCRIPTION OF THE DRAWINGS

The invention will be better understood and other advantages and special features will become clear after reading the following description given as a non-limitative example accompanied by the appended drawings in which:

FIG. 6 is a principle diagram for manufacturing a closed fibrous architecture according to the invention, with each thread originating from it wound on two bobbins, FIG. 7 shows a first set of groups of threads in a Primary Structure, in which each thread forming part of the primary structure is wound on two bobbins according to the invention.

DETAILED PRESENTATION OF CERTAIN ILLUSTRATIVE EMBODIMENTS

The principle of the invention for fabrication of a tubular fibrous architecture closed at one of its ends consists of performing the following operations:

- make and connect pairs of bobbins from threads (threads, roving, ribbons or bundles of threads),
- place the bobbins on the spindles of a loom, arranging them in the required geometry,
- make a fibrous structure called the "Primary Structure" that will form the bottom (or closure) of the fibrous architecture,
- integrate a support (liner or mandrel) conforming with the part to be made, that will support, position and hold the threads in place at crossing points,
- use said threads and the loom to make the textile architecture that will cover the support,
- repeat these steps until the assembly of architectures reaches the required size.

Figure 1:
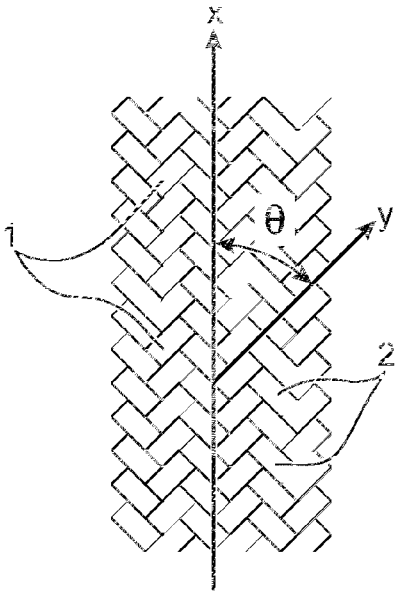
FIG.1 (Prior Art)
FIG. 1, already described, is a view of a biaxial braid composed of a first group of threads and a second group of threads that cross each other, FIG. 2, already described, is a view of a triaxial braid composed of a first group of threads, a second group of threads and a third group of threads that cross over each other, FIG. 3, already described shows the principle diagram of a circular braiding machine, FIG. 4, already described, shows the undulating paths followed by the spindles around the periphery of a circular table of a braiding machine.
Figure 2:
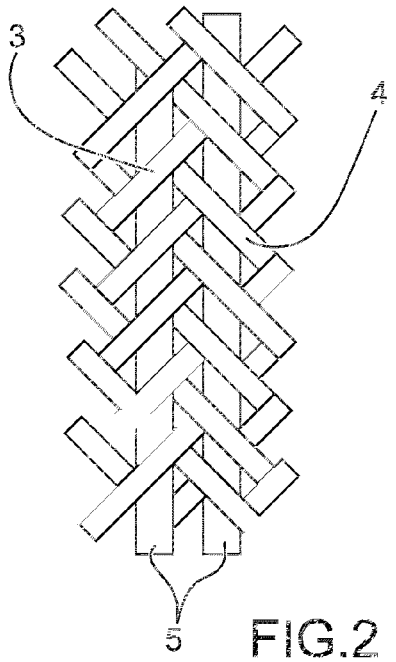
FIG.2 (Prior Art)
Figure 3:
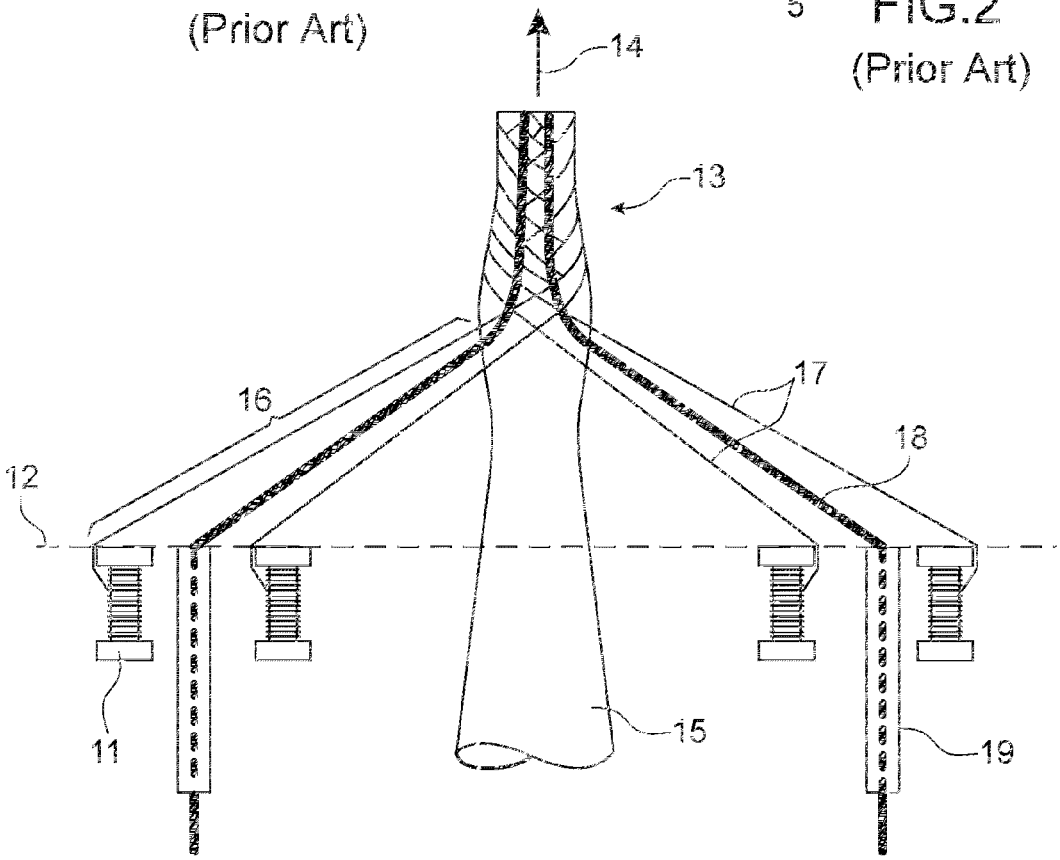
FIG.3 (Prior Art)
Figure 4:
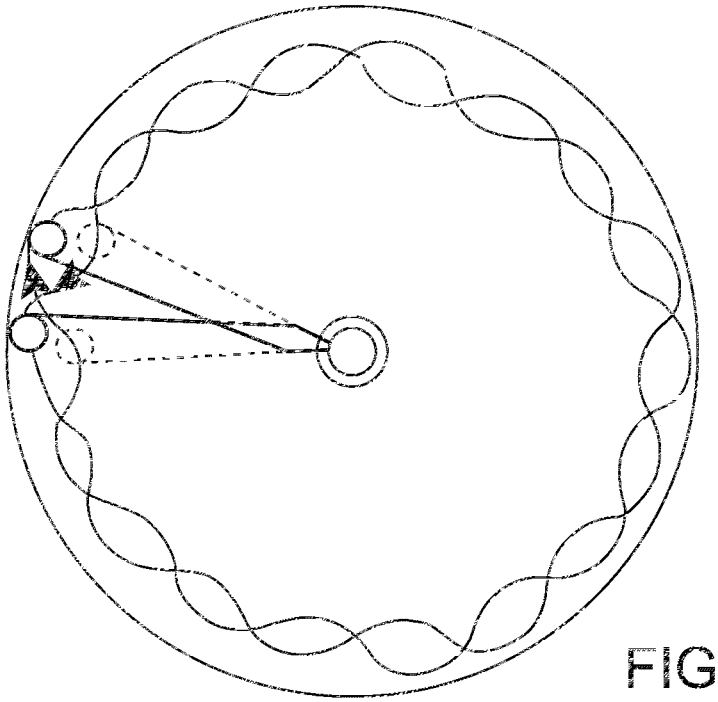
FIG.4 (Prior Art)
Figure 5:
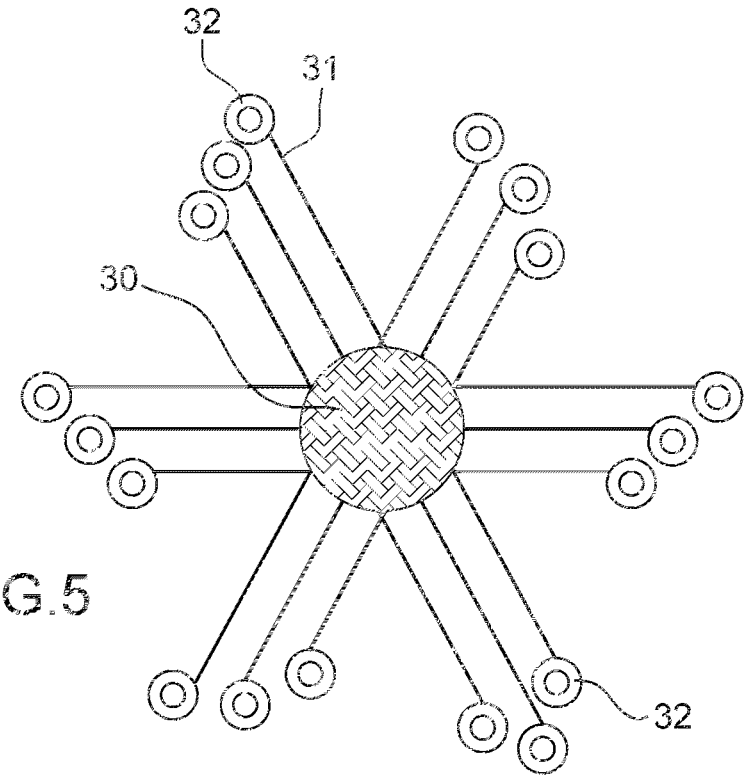
FIG. 5 shows a Primary Structure, with each thread forming the structure wound around two bobbins according to the invention.

FIG. 5 shows a primary structure 30 with the ends wound on two bobbins 32 for each thread 31 forming part of the structure. The primary structure 30 forms a bottom for the tubular structure to be obtained.

The primary structure 30 forming the bottom of the tubular structure is arranged on one end of a mandrel with tubular braiding 34 mounted on a braiding tray 35. Braiding is continued to cover the mandrel 34. This is shown in FIG. 6 that is a principle diagram for braiding the tubular structure to be obtained from threads derived from the Primary Structure forming the bottom.

The design of the primary structure requires that the part made should have the number of threads (or pairs of bobbins) corresponding to the number required for the tubular form (that can be determined from the characteristics of the part that is to be made). The article by M. Munro et al. mentioned above provides further information about this subject.

There are two possible embodiments, direct mode and indirect mode.

With direct mode, the first step is to make pairs of bobbins with a single thread (for each pair). The bobbins thus made are placed on the spindles of the braiding machine with crossing of threads or without crossing in the case of simple batting, to make the primary structure. This latter case is shown in FIG. 7 that shows a first group of parallel threads 41, for which the ends of each thread are wound on the bobbins 42, a second group of parallel threads 43 and a third group of parallel threads 44, the groups of threads being arranged one on the others without crossing. The mandrel is then positioned on the machine and one of its ends is covered with the bottom of the tubular structure thus obtained. Braiding can then continue conventionally.

With indirect mode, the first step is to make the primary structure with the threads each of which is wound onto a bobbin at each of its ends. The primary structure obtained, the mandrel and the bobbins on the spindles are put into place on the braiding machine. Braiding can then be done conventionally.

The primary structure from which the bottom is made can also be made directly on the form or liner to be coated, particularly if the form is not nearly flat and is strongly curved (for example hemispherical).

The primary structure may be made using different techniques. For example, the following three techniques can be mentioned.

According to a first technique, the threads are simply placed along three different directions (see FIG. 7). This technique gives very good conformability and is easy to implement.

Figure 8:
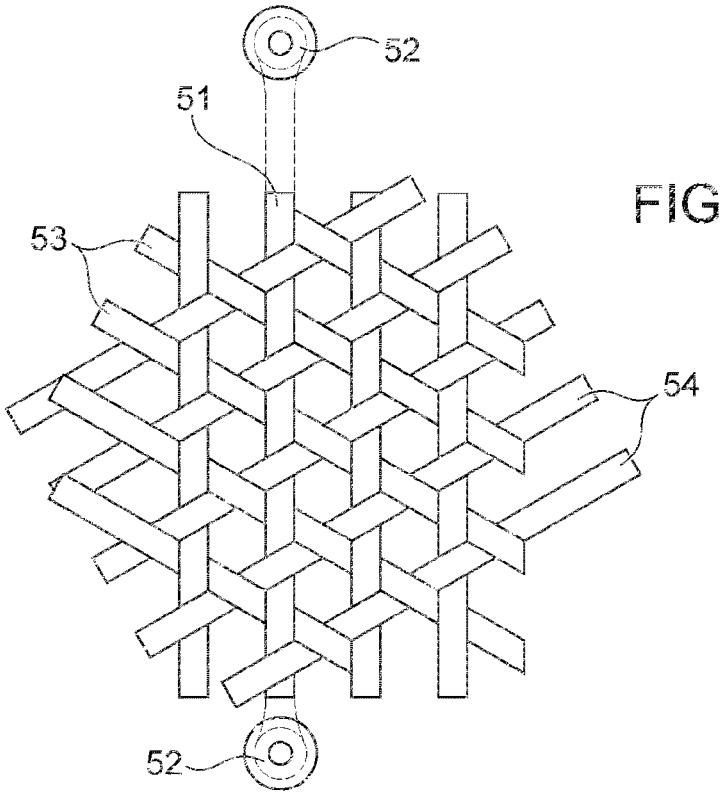
FIG. 8 shows a second set of groups of threads in a Primary Structure, in which each thread forming part of the primary structure is wound on two bobbins according to the invention.

According to a second technique, the threads are placed in triaxial interlacing. FIG. 8 shows this arrangement. A first group of parallel threads 51 can be seen arranged along a first direction, the ends of each thread are wound onto the bobbins 52, a second group of parallel threads 53 arranged along a second direction and a third group of parallel threads 54 arranged along a third direction. This technique maintains structural homogeneity.

Figure 9:
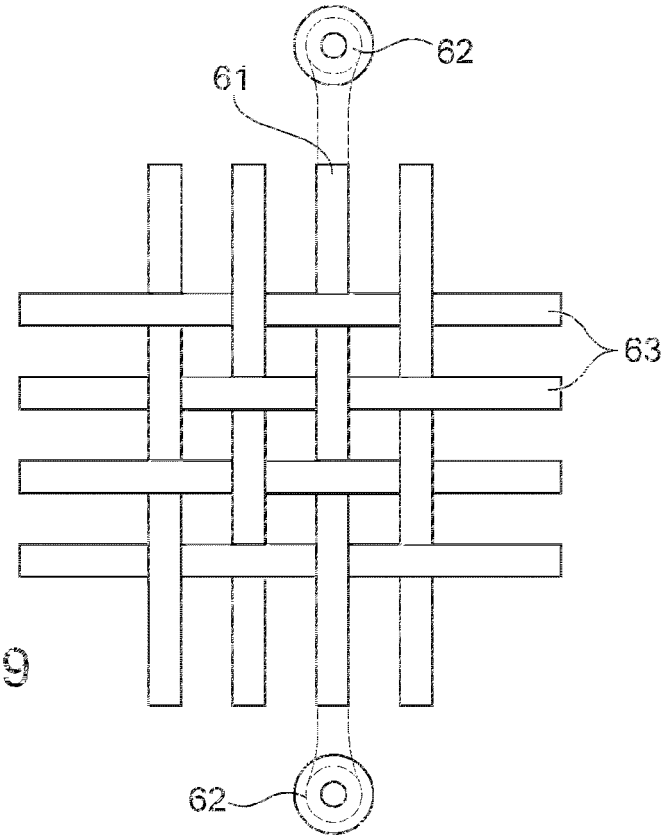
FIG. 9 shows a third set of groups of threads in a Primary Structure, in which each thread forming part of the primary structure is wound on two bobbins according to the invention.

A third technique consists of classical weaving as shown in FIG. 9. This figure shows a first group of parallel threads 61 arranged along a first direction, the ends of each thread being wound on the bobbins 62, and a second group of parallel threads 63 arranged along a second direction perpendicular to the first direction.

These solutions have the advantage that the thickness and fibre content are similar to the thickness and fibre content of the tubular braid that is continuous with the primary structure or the bottom.

Several layers, possibly with different structures, can all be stacked at the same time to form the primary structure. Braiding done for the tubular part may be 2D (biaxial or triaxial) or 3D.

Thick. closed structures can be made by making a stack of layers (bottom and cylindrical part), adding a layer each time using the previously described technique, as is done conventionally for 2D type braids.

Figure 10:
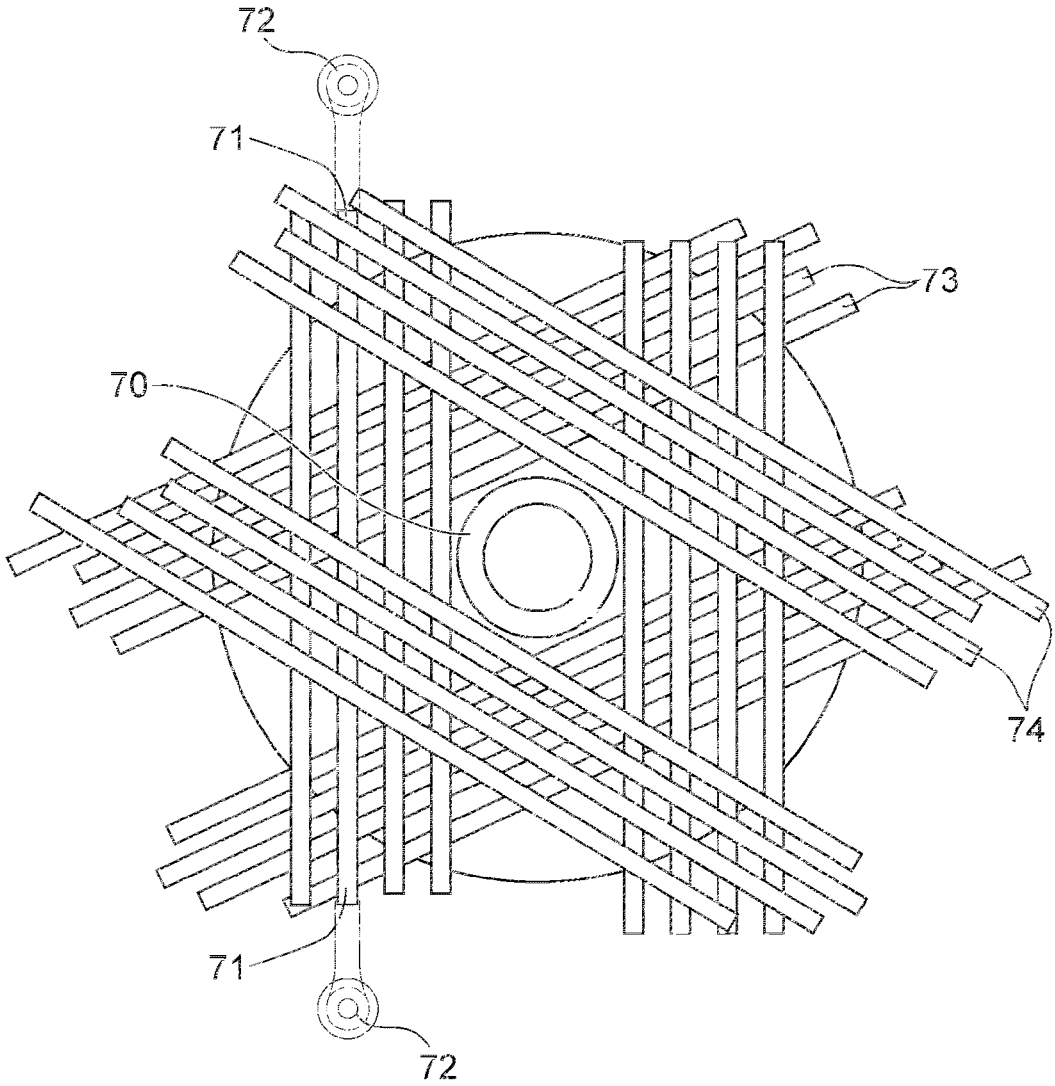
FIG. 10 shows a fourth set of groups of threads in a Primary Structure, in which each thread forming part of the primary structure is wound on two bobbins according to the invention.

Instead of making a completely closed primary structure, a partial closure can be made, or the closure can be made with a large reduction in section. The partial closure may include an end piece or an insert. This is shown in FIG. 10, in which the figure shows a primary structure on a liner with an insert 70, showing only two bobbins 72 derived from the same thread 71 being shown. The primary structure comprises three groups of threads arranged in different directions: a first group of parallel threads 71, a second group of parallel threads 73 and a third group of parallel threads 74.

It is possible to make a total or partial closure at the other end, by stopping braiding of the cylindrical part when the required length has been made, and by inverting the position by a 180° rotation (along the braiding direction) of the part to be braided and moving the bobbins relative to the three axes of symmetry.

The entire principle of the invention may be applied to other techniques that use continuous threads such as placement of fibres, batting of fibres or weaving of fibres. In the same way as above, the following steps can be used:

- use a first technique with a first architecture for the fabrication to incorporate threads connected to bobbins, each of the threads being connected to a bobbin at each of its ends,
- fabrication of a contiguous architecture using a second technique and using the previous bobbins.

This can be used to continuously make parts combining different types of structures.

The structures obtained either by braiding or by the previously described techniques, can be densified by different conventional means as indicated above.

One example embodiment is the production of SiC/SiC test pieces closed at one end for a high temperature composite tube application.

The first step is to make the primary structure of the bottom or the closure (first layer). This can be done by unwinding twelve bobbins of Tyranno SA3 1600 filament fibres (7 μm diameter) and rewinding on twelve other bobbins to have twelve pairs of bobbins with a thread length of about 1 m between the two bobbins. A triaxial structure is made with twelve pairs of bobbins distributed in a balanced manner (with orientations 0°, +120°, −120°).

The next step (second step) is to make the remainder of the braid (first layer). The bottom and the bobbins are brought onto the braiding machine. The bobbins are put into place on the spindles, each bobbin connected to another bobbin being placed respecting the initial geometry of the triaxial structure (see FIG. 8), and the end is put into place on the bottom of 7.0 mm outside diameter 12 cm high graphite mandrel with a hemispherical bottom. Braiding is done by 45° biaxial braiding over the length of the liner and the threads are then cut.

The next step (third step) is to make the three other layers. A second primary structure, repeating the first step is made and is then placed on the fabricated braid as described in the second step. Braiding is done in the same way as in the second step. The two other layers are then made in the same way.

The purpose of the fourth step is to densify the braids by silicon carbide. Braids are densified in a relatively conventional manner. The part is placed in a CVI (Chemical Vapour Infiltration) furnace, in which carbon is deposited about 0.2 μm thick in interphase (deposition conditions: T=1000° C., P=5 kPa, precursor: propane, residence time=3 s, propane insertion time=5 minutes 30 s) followed by a deposit of SiC (T=950° C., P=2 kPa, precursor: 25% methyltrichlorosilane in hydrogen, residence time=1 s, infiltration time: 60 h). The graphite mandrel is then eliminated. The composite SiC/SiC density obtained is 2.5.

What is claimed is:

1. A method of fabricating a tubular fibrous architecture closed at one of its ends, the method comprising:

forming a plurality of pairs of bobbins using a textile material, the textile material including at least one of a thread, roving, ribbon, or bundles of threads, each pair of bobbins being formed by winding a first part of the textile material, from a first end of the textile material, onto a first bobbin in the pair and winding a second part of the textile material from the second end of the textile material, onto the second bobbin of the pair;

placing pairs of bobbins on spindles of a loom, the pairs of bobbins being arranged on the spindles as a function of a primary structure, forming the primary structure on the loom, the primary structure corresponding to the bottom of the fibrous architecture;

placing a support conforming with the tubular part of the fibrous architecture into position on a loom; and using the textile materials and the loom to form the tubular part of the fibrous architecture on the support, the support being configured to support, position, and maintain the textile materials during crossover of the textile materials.

2. The method according to claim 1, wherein the pairs of bobbins are arranged such that the primary structure is radiating.

3. The method according to claim 1, wherein the pairs of bobbins are arranged such that the primary structure is of the biaxial type.

4. The method according to claim 1, wherein the pairs of bobbins are arranged on the spindles and in the creel of the loom such that the primary structure is triaxial.

5. The method according to claim 1, wherein the threads on the bobbins are supported, positioned, and held in place so as to obtain a biaxial tubular architecture.

6. The method according to claim 1, wherein the threads on the bobbins are supported, positioned, and held in place so as to obtain a triaxial tubular architecture.

7. The method according to claim 1, wherein a single loom is used to fabricate the tubular fibrous architecture.

8. The method according to claim 1, wherein the primary structure is fabricated using a technique selected from one of: weaving, braiding, batting, or textile material placement.

9. The method according to claim 1, wherein the primary structure comprises a multi-layer, multi-dimensional, or multi-directional texture, wherein the textile materials derived from it are used to make the tubular part, and wherein the tubular part comprises a multi-layer structure.

10. The method according to claim 1, wherein the tubular part of the fibrous architecture is fabricated on the support using a technique selected from one of: weaving, braiding, batting, or textile material placement.

11. The method according to claim 1, wherein the tubular part of the fibrous architecture is fabricated on the support using multi-layer, multi-dimensional, or multi-directional texture methods.

12. The method according to claim 1, wherein the loom having the support is selected from one of: a weaving loom, a braiding machine, a batting machine, or a textile material placement machine.

13. The method according to claim 1, further comprising extending the tubular part of the fibrous architecture on one end of the support to form a second bottom of the fibrous architecture.

14. The method according to claim 13, wherein extending the tubular part is continued until a second closed bottom is obtained by braiding, weaving, batting, or textile material placement.

15. The method according to claim 1, wherein the primary structure is fabricated by incorporating at least one insert or at least one end piece into the primary structure.

16. The method according to claim 1, wherein the tubular part of the fibrous architecture is fabricated by incorporating at least one insert or at least one end piece into the tubular part.

17. A tubular fibrous architecture with a closed tubular part formed on at least one of its ends or bottom, wherein:

the tubular part comprises an architecture in which at least one textile material is continuously output from the bottom, the textile material comprising at least one of a thread, roving, ribbon, or bundle of threads; and continuously winding each textile material, from each end of each textile material output from the bottom, about the tubular part, wherein all textile materials at the junction between the bottom and the remainder of the tubular part are continuous and there is a continuous geometric transition between the bottom architecture and the architecture of the remainder of the tubular part, and wherein the textile materials in the tubular part cross over.

18. The fibrous architecture according to claim 17, wherein the bottom is formed of a structure obtained by superposition of batting, a two-directional fabric, three-directional fabric, multi-layer, or multi-directional fabric.

19. The fibrous architecture according to claim 17, wherein the tubular part is formed by one of superposition of batting, three-dimensional fabric, multi-layer, or multi-directional fabric.

20. The fibrous architecture according to claim 17, wherein at least one insert or end piece is incorporated into at least one bottom.

21. The fibrous architecture according to claim 17, wherein at least one insert or end piece is incorporated into the tubular part.

22. The fibrous architecture according to claims 17, wherein the threads are formed of organic, metallic, mineral, or ceramic fibers.

23. A composite material comprising the fibrous architecture according to claim 17, wherein the composite material is embedded in an organic, metallic, or mineral matrix.

24. The method according to claim 1, further comprising repeatedly forming a pair of bobbins, placing pairs of bobbins on spindles of a loom, placing a support confirming with the tubular part, and using the textile materials and the loom to form the tubular part.

25. The fibrous architecture according to claim 17, further comprising using a binding or weaving method to cross over the textile materials on the tubular part.

* * * * *